US008770498B2

(12) United States Patent
Reiter et al.

(10) Patent No.: US 8,770,498 B2
(45) Date of Patent: Jul. 8, 2014

(54) FUEL INJECTOR

(75) Inventors: Ferdinand Reiter, Markgroeningen (DE); Christof Vogel, Bischberg (DE); Chris Louis, Hanahan, SC (US); Gerald Scheday, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 1095 days.

(21) Appl. No.: 11/988,982

(22) PCT Filed: Jul. 26, 2006

(86) PCT No.: PCT/EP2006/064660

§ 371 (c)(1),
(2), (4) Date: May 19, 2014

(87) PCT Pub. No.: WO2007/014887

PCT Pub. Date: Feb. 8, 2007

(65) Prior Publication Data

US 2009/0179091 A1 Jul. 16, 2009

(30) Foreign Application Priority Data

Aug. 4, 2005 (DE) ..... 10 2005 037 319

(51) Int. Cl.
*B05B 1/30* (2006.01)
*F02M 51/00* (2006.01)

(52) U.S. Cl.
USPC ..... 239/585.3; 239/584; 239/585.1; 239/585.4; 239/DIG. 4

(58) Field of Classification Search
USPC ..... 239/533.11, 583, 584, 585.1, 585.2, 239/585.3, 585.4, 585.5, DIG. 4
See application file for complete search history.

(56) References Cited

U.S. PATENT DOCUMENTS

| | | | | |
|---|---|---|---|---|
| 5,188,297 | A * | 2/1993 | Asano | 239/585.3 |
| 5,634,596 | A * | 6/1997 | Abiko | 239/585.5 |
| 5,918,818 | A * | 7/1999 | Takeda | 239/585.1 |

FOREIGN PATENT DOCUMENTS

| | | |
|---|---|---|
| DE | 40 03 227 | 1/1991 |
| JP | 2003-269290 | 9/2003 |
| WO | WO 99/01661 | 1/1999 |

* cited by examiner

*Primary Examiner* — Ryan Reis
(74) *Attorney, Agent, or Firm* — Kenyon & Kenyon LLP

(57) ABSTRACT

A fuel injector includes a solenoid coil, which cooperates with an armature acted upon by a restoring spring, the armature forming an axially displaceable valve part together with a valve needle. A valve-closure member, which forms a sealing seat together with a valve-seat body, is provided on the valve needle. Furthermore, a reliable sealing of a thin-walled valve sleeve or of the magnetic coil exists that is made of a sealing body that is secured beneath the magnetic coil. The sealing body is tetragonal in cross-section, in particular, it has a trapezoid-like shape, and is put in between the magnetic coil and a valve housing. In its installed state, the sealing body is clamped and compressed. In its compressed state, the sealing body assumes an elliptical or egg-shaped cross-section.

12 Claims, 2 Drawing Sheets

FUEL INJECTOR

BACKGROUND INFORMATION

German Patent Application No. DE 40 03 227, for instance, describes a fuel injector which includes a core surrounded by a solenoid coil, an armature by which a valve-closure member cooperating with a fixed valve seat is actuable with the aid of a connecting tube welded to the armature; a tubular metal intermediate part which, by welding, is sealingly connected to an end of the core facing the armature via its one end, and to a tubular connecting part via its other end; and at least one bracket-type conducting element, which overlaps the solenoid coil and, by welding, is connected to the connecting part by its end facing the valve-closure member, and to the core via its other end. In each case the welding of two overlapping components of the fuel injector is implemented in a region of reduced cross-section of one of the two components to be welded together.

A particular disadvantage of this fuel injector is that the production of the connections between the individual components of the fuel injector is complicated and therefore time-consuming and cost-intensive. Furthermore, the welded points are thermally stressed and thus lose strength and flexural stiffness, which can result in considerable resonances due to housing parts having varying thickness and in an associated generation of noise when operating the fuel injector. In addition, a support ring, which is injection-molded underneath the seal on the side of the intake manifold, has the effect that contact points between the housing and valve sleeve are not reliably sealed, which may lead to problems due to poor sealing, especially during turbo-operation of the internal combustion engine.

SUMMARY OF THE INVENTION

An advantage of the fuel injector according to the present invention is that a reliable axial sealing by a fuel-resistant elastomer is possible between the valve housing, a valve sleeve, and a solenoid coil. This sealing is a sealing body having a tetragonal cross-section and preferably made of rubber, which has the advantage that the used sealing body is simple and cost-effective. An additional advantage is that the sealing body requires inside of the fuel injector only a small amount of space that is reduced even further when the sealing body, in its installed state, is clamped and compressed after assembly.

It is advantageous to give the sealing body a trapezoid-like design, this cross-sectional contour existing only when the sealing body is in an uncompressed state.

It is particularly advantageous to place the sealing body in the area between an underside of a coil brace that accommodates the solenoid coil, an external lateral surface of a valve sleeve, and a radially extending shoulder of the valve housing. In the completely installed state, the sealing body largely fills this receiving region and guarantees via its direct physical contact to these valve components a safe and reliable sealing. Ultimately, in its compressed state, the sealing body has an elliptical or egg-shaped cross-section.

In this instance, the coil brace may ideally have a peripheral collar or multiple nubs distributed around the circumference so as to limit the receiving area of the sealing body radially toward the outside.

DETAILED DESCRIPTION

Figure 1:
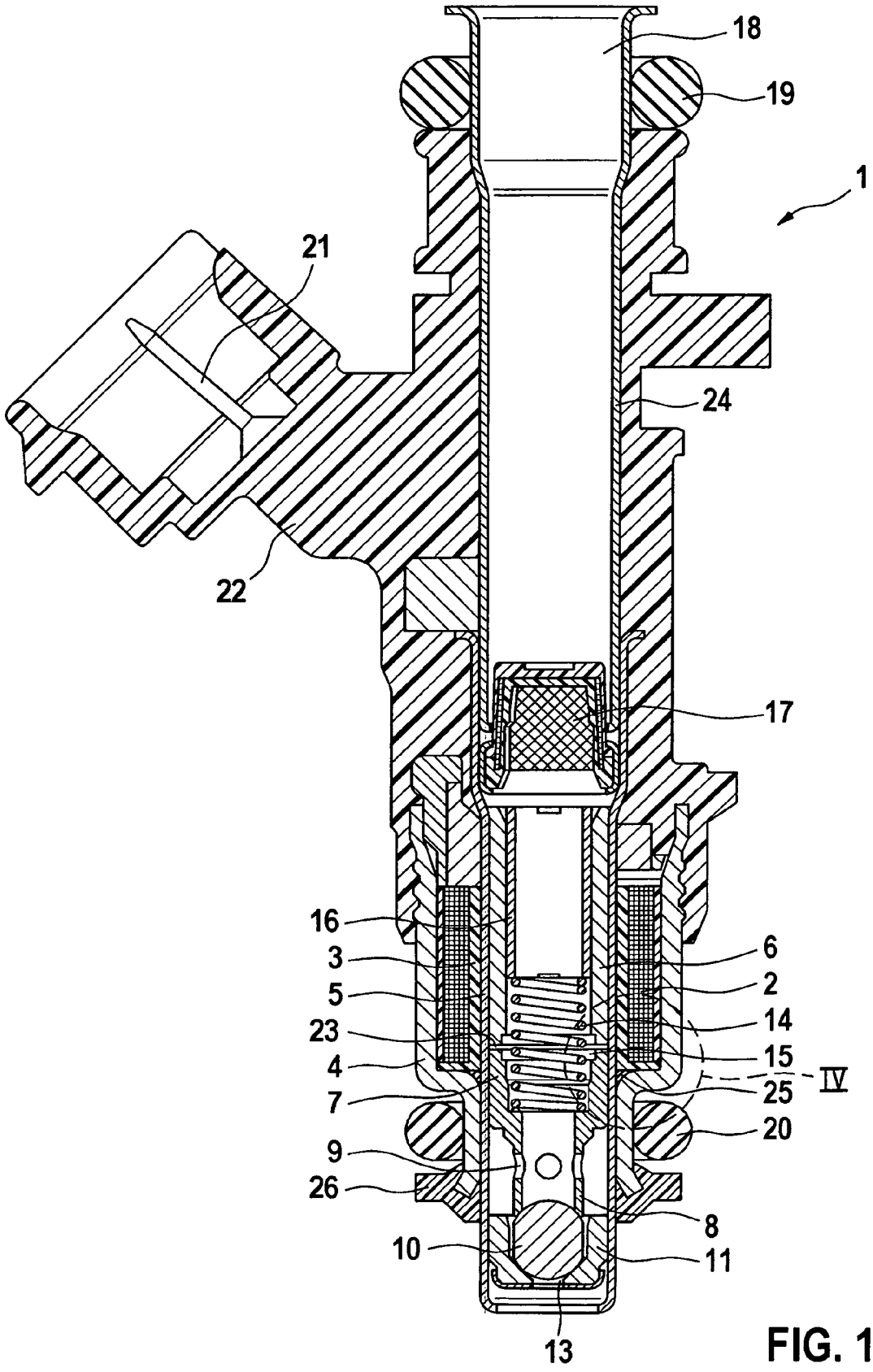
FIG. 1 shows a schematic section through an exemplary embodiment of a fuel injector designed according to the present invention.

In the following text, a first exemplary embodiment of the present invention is described by way of example on the basis of FIG. 1. FIG. 1 shows a schematic sectional representation of a longitudinal section through an exemplary embodiment of a fuel injector 1 designed according to the present invention, fuel injector 1 being suited, in particular, for the injection of fuel into an intake manifold (not shown further) of an internal combustion engine.

Fuel injector 1 includes a solenoid (magnetic) coil 2, which is wound on a coil brace 3. Coil brace 3 is encapsulated in a cup-shaped valve housing 4 that is used as a solenoid cup of the electromagnetic circuit.

Coil brace 3 is penetrated by a valve sleeve 5 having a tubular design. Downstream from inner pole 6, which is situated in the valve sleeve 5, an armature 7 is situated, which is connected to a valve needle 8. Valve needle 8 is in operative connection with a valve-closure member 10, which has a spherical form in the exemplary embodiment and forms a sealing seat together with a valve-seat body 11. Downstream from the sealing seat at least one spray-discharge orifice 13 is formed from which the fuel is injected into the intake manifold (not shown further).

In the rest state of fuel injector 1, armature 7 is acted upon by a restoring spring 14 with a force such that fuel injector 1 is held closed by the contact pressure of valve-closure member 10 on valve-seat body 11. Restoring spring 14 is situated in a recess 15 of armature 7 or inner pole 6 and is prestressed by an adjusting sleeve 16. On the inflow side of adjusting sleeve 16, a cup-shaped filter element 17 is preferably pressed into valve sleeve 5. The fuel, which is conveyed via a central fuel supply 18, flows through fuel injector 1 through a supply pipe 24, recess 15, and flows to valve-seat body 11 and to spray-discharge orifice 13.

For the purpose of installation on a fuel-distributor line (not shown further), fuel injector 1 is provided with a seal 19 in the region of central fuel supply 18. An additional seal 20 seals the connection (not shown further) between fuel injector 1 and the intake manifold. Solenoid coil 2 is energized via a line by an electric current, which can be supplied via an electrical plug contact 21. Plug contact 21 is part of an electrical power plug 22 made of plastic that can be injection-molded via a plastic extrusion coat on valve housing 4, on valve sleeve 5 or on supply pipe 24.

If an electric current is supplied to solenoid coil 2 via an electrical line (not shown further), a magnetic field is generated that, if sufficiently strong, pulls armature 7 into solenoid coil 2, counter to the force of restoring spring 14 and counter to the flow direction of the fuel. This closes a working gap 23 formed between armature 7 and inner pole 6. The movement of armature 7 also carries along in the lift direction valve needle 8, which is connected to armature 7, so that valve-closure member 10 lifts off from valve-seat member 11 and fuel is spray-discharged via spray-discharge orifice 13.

Fuel injector 1 is closed as soon as the current energizing solenoid coil 2 is turned off and the magnetic field has decayed to the point where restoring spring 14 presses armature 7 away from inner pole 6, which causes valve needle 8 to move in the discharge direction and valve-closure member 10 to come to rest on valve-seat body 11.

Valve sleeve 5 has a tubular design. According to the present invention, provisions are made for a sealing body 25 made of an elastomeric material, preferably of rubber, between valve housing 4, coil brace 3, and valve sleeve 5 which provides a reliable sealing of valve sleeve 5 from valve housing 4.

Figure 2:
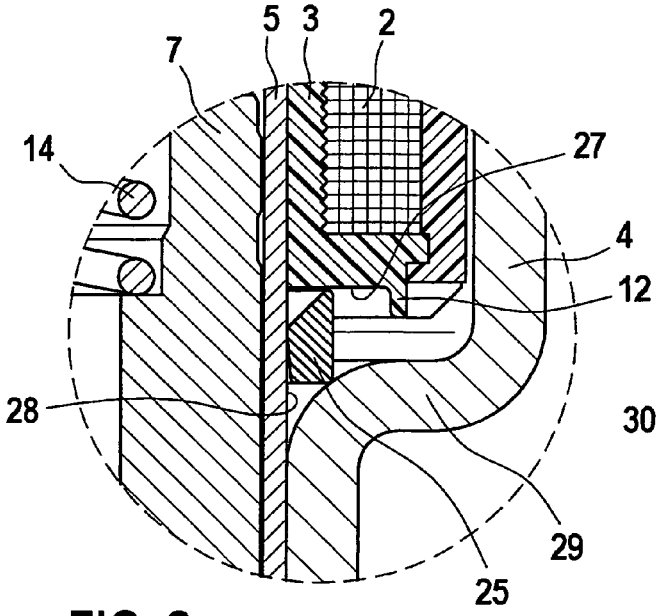
FIG. 2 shows a schematic partial section through the fuel injector, designed according to the present invention, in the area of section IV in FIG. 1 having a not-yet-compressed sealing body.
Figure 3:
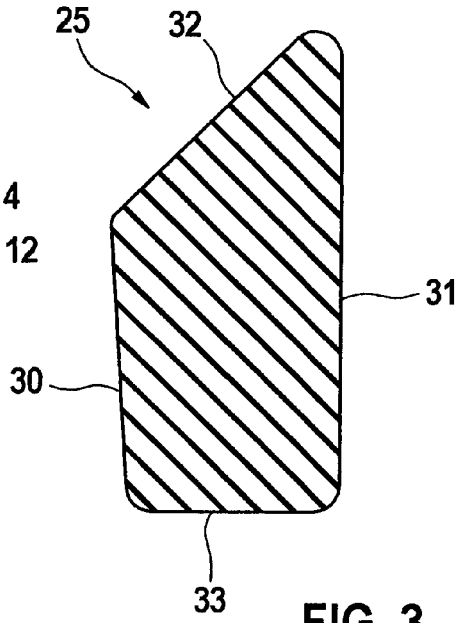
FIG. 3 shows an enlarged illustration of a cross-section of the sealing body.

FIG. 2 shows a schematic partial section through fuel injector 1, configured according to the present invention, in the area of section IV in FIG. 1 having a not-yet-compressed sealing body 25. Sealing body 25 is tetragonal and has a trapezoid-like design in the cross-section. Sealing body 25 is installed in such a way that sealing body 25 is inserted in the area between underside 27 of coil brace 3, an outer lateral surface 28 of the valve sleeve 5, and radially extending shoulder 29 of valve housing 4. While valve housing 4 is already secured or held on valve sleeve 5, coil brace 3 having magnetic coil 2 is inserted only after the introduction of sealing body 25 into valve housing 4. At this time, sealing body 25 is in an uncompressed state having a ring-shaped contour and a rectangle-shaped cross-section, as shown in FIG. 3.

With its inner side 30, sealing body 25 abuts against outer lateral surface 28 of valve sleeve 5, inner side 30 and lateral surface 28 running not exactly parallel. Rather, sealing body 25 runs with its inner side 30 slightly inclined toward the longitudinal axis of fuel injector 1 and thus also inclined toward lateral surface 28 of valve sleeve 5 or to outer side 31 of sealing body 25. For this reason, the cross-section of sealing body 25 does not form an ideal trapezoid, but rather only approximates this shape. Upper side 32 of sealing body 25, which is facing coil brace 3, extends at an angle to the longitudinal axis of fuel injector 1, for example, at a 45° angle, while underside 33 of sealing body 25, which faces shoulder 29, extends at a right angle to the longitudinal axis of fuel injector 1. The corners of sealing body 25 are, for example, rounded, the radii of all rounded corners possibly varying.

Figure 4:
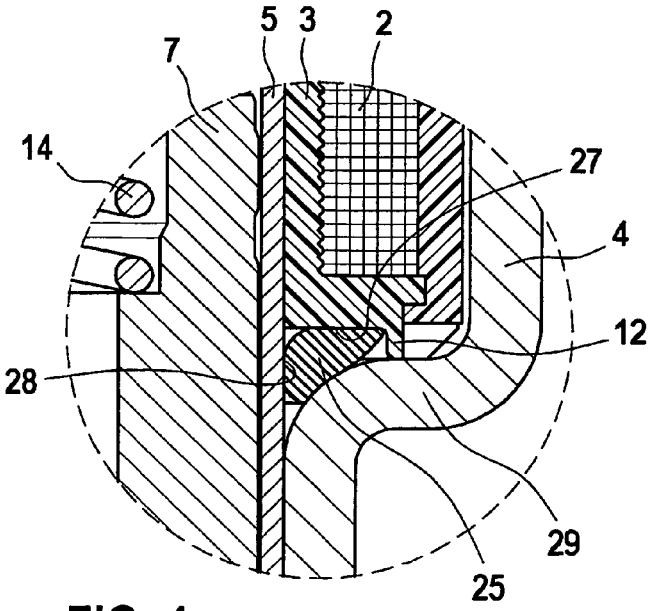
FIG. 4 shows a schematic partial section through the fuel injector, designed according to the present invention, in the area of section IV in FIG. 1 having a compressed sealing body in the installed state after assembly.

Coil brace 3 has on its underside 27 a radially circumferential collar 12 that is situated radially outside of sealing body 25 and that abuts on shoulder 29 of valve housing 4 when sealing body 25 is in a compressed state (FIG. 4). As an alternative to a circumferential collar 12, it is also possible to provide a plurality of nubs on underside 27 of coil brace 3 in a radially symmetrical manner.

During installation of sealing body 25 or assembly of fuel injector 1, at some time the point is reached at which coil brace 3 touches for the first time with its underside 27 sealing body 25 at its highest point, which is shown in FIG. 2. This highest point of sealing body 25 lies in the (rounded) corner area of the transition from upper side 32 to outer side 31. From this moment on, sealing body 25 is deformed during further assembly.

FIG. 4 shows a schematic partial section through fuel injector 1, configured according to the present invention, in the area of section IV in FIG. 1 having a sealing body 25 compressed in the installed state after assembly. When it is deformed during assembly, the elastomer material of sealing body 25 migrates to a great extent radially in an outward direction. The material, however, also spreads slightly in other directions so that an optimal sealing can be achieved by sealing body 25 according to the present invention. Collar 12 of coil brace 3, which migrates downward during assembly, provides a radially external boundary for the migratory movement of sealing body 25 so that in the completely installed state sealing body 2 is clamped and compressed between underside 27 of coil brace 3, collar 12 of coil brace 3, shoulder 29 of valve housing 4, and outer lateral surface 28 of valve sleeve 5, and has physical contact to these components. In this respect, the size of collar 12 determines the degree of the deformation of sealing body 25. The tetragonal cross-sectional contour of sealing body 25 in its initial state is in a certain sense abolished in the installed and compressed state since sealing body 25 now has an elliptical or egg-shaped cross-section.

The present invention is not limited to the exemplary embodiment shown. In particular, any combination of the individual features is possible.

What is claimed is:

1. A fuel injector comprising:

a restoring spring;

a valve housing;

a valve-seat body;

a valve needle;

an armature acted upon by the restoring spring, the armature forming an axially displaceable valve part together with the valve needle;

a solenoid coil cooperating with the armature;

a valve-closure member forming a sealing seat together with the valve-seat body being situated on the valve needle; and a sealing body being tetragonal in cross-section and being situated in between the coil and the valve housing, the valve housing including a radially extending shoulder under the coil, and the sealing body being situated between an underside of the coil and the radially extending shoulder of the valve housing.

2. The fuel injector according to claim 1, wherein the sealing body is composed of a fuel-resistant elastomer material, including rubber.

3. The fuel injector according to claim 1, wherein the sealing body runs around in an annular shape and in a decompressed state has a trapezoid-like cross-section.

4. The fuel injector according to claim 3, wherein the sealing body has an inner side, an outer side, an upper side and an underside, a largest axial dimension of the sealing body lying between transitions from the outer side to the upper side and the underside.

5. The fuel injector according to claim 2, wherein the inner side and the outer side do not run parallel to each other.

6. The fuel injector according to claim 1, wherein corners of the sealing body are rounded off.

7. The fuel injector according to claim 6, wherein radii of the rounded corners of the sealing body vary.

8. The fuel injector according to claim 1, further comprising a valve sleeve and a coil brace, and wherein the sealing body is situated in an area between an underside of the coil brace accommodating the coil, an outer lateral surface of the valve sleeve, and the radially extending shoulder of the valve housing.

9. The fuel injector according to claim 8, wherein the coil brace has on its underside a circumferential collar or multiple nubs distributed over a circumference that limit radially outward a receiving region of the sealing body.

10. The fuel injector according to claim 1, wherein the sealing body is clamped and compressed in an installed state.

11. The fuel injector according to claim 9, wherein the sealing body in a completely installed state is clamped between the underside of the coil brace, the collar or the nubs of the coil brace, the outer lateral surface of the valve sleeve, and the shoulder of the valve housing having physical contact to these components.

12. The fuel injector according to claim 1, wherein the sealing body in its compressed state has an elliptical or egg-shaped cross-section.

* * * * *